US007471770B2

(12) United States Patent
Lendl

(10) Patent No.: US 7,471,770 B2
(45) Date of Patent: Dec. 30, 2008

(54) RADIOSCOPY DEVICE

(75) Inventor: Markus Lendl, Ottensoos (DE)

(73) Assignee: Siemens Aktiengesellschaft, Munich (DE)

( * ) Notice: Subject to any disclaimer, the term of this patent is extended or adjusted under 35 U.S.C. 154(b) by 191 days.

(21) Appl. No.: 11/653,142

(22) Filed: Jan. 12, 2007

(65) Prior Publication Data

US 2007/0183586 A1 Aug. 9, 2007

(30) Foreign Application Priority Data

Jan. 12, 2006 (DE) ..... 10 2006 001 669
May 26, 2006 (DE) ..... 10 2006 024 738

(51) Int. Cl.
*G21K 1/00* (2006.01)

(52) U.S. Cl. ..... 378/154; 378/155

(58) Field of Classification Search ..... 378/4, 378/6, 7, 19, 70, 86, 147–155
See application file for complete search history.

(56) References Cited

U.S. PATENT DOCUMENTS 6,968,041 B2 11/2005 Hoheisel et al.
7,110,507 B2 * 9/2006 Schmitt ..... 378/154
2003/0076929 A1 4/2003 Hoheisel et al.
2004/0156479 A1 8/2004 Hoheisel et al.
2005/0190888 A1 9/2005 Schmitt
2006/0062446 A1 * 3/2006 Porat ..... 382/154

FOREIGN PATENT DOCUMENTS

DE 103 05 106 A1 8/2004
DE 103 55 616 A1 7/2005
JP 2003 03 84 83 A 2/2003

OTHER PUBLICATIONS

German Office Action for DE 10 2006 024 738.8 2006 and English translation.
German Office Action dated Dec. 11, 2007 for DE 10 2007 001 926.4-51 and English translation.

* cited by examiner

*Primary Examiner*—Irakli Kiknadze
(74) *Attorney, Agent, or Firm*—Brinks, Hofer, Gilson & Lione

(57) ABSTRACT

A radioscopy device is provided. The radioscopy device includes a detector grid; and a scattered radiation matrix. The detector grid is disposed relative to the scattered radiation matrix, which is substantially perpendicular to a direction in which the integral across both location-frequency coordinates of the Fourier transforms of the detector grid and the scattered radiation matrix is at a minimum.

17 Claims, 6 Drawing Sheets

RADIOSCOPY DEVICE

This patent document claims the benefit of DE 10 2006 001 669.6 filed Jan. 12, 2006, and DE 10 2006 024 738.8 filed May 26, 2006, both of which are hereby incorporated by reference.

BACKGROUND

The present embodiments relate to a radioscopy device, which includes a detector grid and a scattered radiation matrix.

In radiological imaging, stringent demands are made in terms of image quality. In radiological images, for example, in medical radiological diagnosis, an object to be examined has X-radiation from an approximately point-shaped X-ray source passed through it. The distribution of the attenuation of the X-radiation on the side of the object diametrically opposite the X-ray source is detected two-dimensionally with a detector.

The radiation originating at the X-ray source includes primary rays and scattered rays. The primary rays strike the detector rectilinearly. Scattered rays are scattered in the object because of unavoidable interactions. The scattered rays may also strike the detector. The scattered rays, which as a function of properties of the object, can make up over 90% of the total signal striking the detector in the case of diagnostic images. The scattered rays represent an unwanted noise source, which makes the detectability of fine differences in contrast considerably more difficult.

To reduce the scattered rays striking the detector, a scattered radiation matrix is placed between the object and the detector. The scattered radiation matrix includes regular absorbing structures that absorb the X-radiation, and between the absorbing structures, through conduits are embodied for the passage of primary rays with little or no attenuation. Scattered radiation matrixes generally comprise alternating, very thin strips of lead, paper, plastic or aluminum. However, the absorbing structures cause image interference. Image interference is reduced using the thinnest and most uniform possible embodiment of the absorbing structures.

In X-ray radioscopy, the conventional film/foil systems are increasingly being replaced by electronic imaging systems, which are essentially digital imaging systems. Electronic imaging systems scan the analog image signal, for example, by using CCD image amplifiers or a flat detector. The analog image signal may be reprocessed and stored in memory. Such scanning systems include individual identical receptor elements, which are the CCD or semiconductor detector elements, disposed in a uniform grid. Because of the production technology, these elements are generally not square and do not completely fill the area available for a single element with a receptive area, for example, the fill factor is less than 100%.

When digital detectors are used in conjunction with regular, immobile scattered radiation matrixes, the structures of the pixels can interfere with those of the scattered radiation matrixes. If very fine scattered radiation matrixes are used, for example, whose number of lines is in the range of the scanning frequency of the detectors, then in addition to the direct image interference of the absorbing structures, moiré artifacts are created. Moiré artifacts are additional image interferences that are an impairment to the medical evaluation.

To minimize moiré artifacts, German Patent Disclosure DE 103 05 106 A1 arranges absorbing structures of the scattered radiation matrix in the form of random, aperiodic patterns. However, the production of such structures is complicated and expensive.

SUMMARY

The present embodiments may obviate one or more of the limitations of the related art. For example, in one embodiment, a radioscopy device uses a fine, regular scattered radiation matrix in conjunction with a digital detector and is capable of furnishing a high image quality and optimally suppressing moiré artifacts.

In one embodiment, a radioscopy device includes a detector grid and a scattered radiation matrix. The detector grid is disposed relative to the scattered radiation matrix substantially perpendicular to a direction in which the integral across both location-frequency coordinates of the Fourier transforms of the units that are rotatable relative to one another is at a minimum. In this embodiment, the scattered radiation matrix and the detector may be adapted to one another in such a way that moiré artifacts that systematically occur are minimized.

In this embodiment, a series of experiments for retroactive optimization may be no longer required. This embodiment also provides great flexibility in the production of the radioscopy device because the a detector grid and the scattered radiation matrix may be adapted to one another both in the parameter of their direction to one another, for example, their installation angle, and in the parameter of their grid width. In one embodiment, once one of the two parameters is defined, the other parameter may be adjusted so that optimal suppression of the moiré artifacts is attained. The integral is an area integral of both coordinates from $-\infty$ to $+\infty$.

In one embodiment, the Fourier transform of the scattered radiation matrix is simplified to Dirac pulses, and the integration is approximated to the points of the Dirac pulses by the sum of the values of the Fourier transform of the detector grid. In this embodiment, the computation effort and expense for ascertaining an advantageous disposition of the units to one another may be minimized. In one embodiment, the scattered radiation matrix has a regular, for example, two-dimensional disposition, such as a regular rectangular or hexagonal grid structure.

The Fourier transform of the scattered radiation matrix can be treated in a first approximation as a number of Dirac pulses—such as four Dirac pulses for a rectangular grid—and the multiplication of the Fourier transforms can be limited to the location of the Dirac pulses. If standardized Fourier transforms are selected, the amplitude of the Fourier transform of the scattered radiation matrix can be set to 1, and instead of the product alone, the Fourier transform of the detector grid is totalled at the locations of the Dirac pulses, or in other words at four points in the case of a rectangular scattered radiation matrix. If the scattered radiation matrix is laid out in width and in the shape of its grid members in such a way that the first approximation is found to be inadequate, then in a second approximation, primary oscillations of the Fourier spectrum—analogous to the Dirac pulses—can be introduced spatially discretely as points into the product, and the sum of the Fourier transforms of the detector grid at these points can be formed, advantageously weighted in each case with the intensity of the primary oscillations at the corresponding points.

In one embodiment, the scattered radiation matrix is a one-dimensional grid. In this embodiment, the detector grid is disposed relative to the scattered radiation matrix substantially perpendicular to a direction in which the two-dimensional Fourier transform of the detector grid, evaluated on a circular ring placed around the origin of the Fourier transform, is at a minimum. The circular ring characterizes the frequency of the scattered radiation matrix. For example, the number of lines and the installation angle between the scattered radiation matrix and the detector can be selected such that the analog matrix signal—observed in the Fourier transform, or in other words in the location-frequency space—coincides with a minimum, optimally a zero place region, of the two-dimensional Fourier transform of the detector grid. The analog matrix signal is generated by homogeneous irradiation of the scattered radiation matrix precisely.

In one embodiment, when the scattered radiation matrix is a one-dimensional grid, the Fourier transform of the scattered radiation matrix is formed in a first approximation of two Dirac pulses disposed point-symmetrically around the origin. In this embodiment, the Fourier transform of the detector grid is symmetrical to the origin. Accordingly, it is sufficient to evaluate the Fourier transform of the detector grid at the point of one of the Dirac pulses. Upon rotation of the grid or the units to one another, the Dirac pulse is located on the circular ring, whose radius defines the frequency of the scattered radiation matrix. In one embodiment, if the Dirac pulse is located at a minimum of the Fourier transform of the detector grid, then the integral of the product of the two Fourier transforms—in a first approximation, which is sufficient for the purposes of the present embodiment—is minimized.

In one embodiment, minimum, standardized Fourier transforms are evaluated. The minimum need not be an absolute minimum, for example, the minimum may be a local minimum. In one embodiment, it suffices if one of the detector grid or the scattered radiation matrix is disposed relative to the other direction at least substantially perpendicular to the direction. Deviations of a few degrees, for example, up to 5°, are within the allowable tolerance range.

Simple and economical production of the detector grid or the scattered radiation matrix can be achieved if they have a regular structure. Regular structures are especially suitable for Fourier evaluation. The regular structure in one embodiment expediently extends over a range of at least five pixel lengths or more of the detector grid.

In one embodiment, the grid widths or the number of lines of the scattered radiation matrix are an integral multiple, preferably an even-numbered multiple, of the scanning frequency. In this embodiment, while no damping of the matrix signal is accomplished interference, other than the moiré artifacts, is produced as an additive direct component in the resultant image, which is easy to compensate for, for example, by regulation to a constant mean value.

In one embodiment, if the detector grid is meant to assure high resolution, then an extremely fine scattered radiation matrix is used. In this embodiment, the frequencies of the two units, for example, of the detector grid and of the scattered radiation matrix, differ maximally from one another by a factor of 2. Given present detector grid widths, a relatively coarse scattered radiation matrix that is relatively invulnerable to malfunction can be used, whose matrix width is on the order of magnitude of that of the detector grid.

In one embodiment, optimal suppression of unwanted line patterns in the image can be attained if the grid width of the scattered radiation matrix is maximally slightly wider than the grid width of the detector grid. For example, the slightness extends up to a factor of about 1.2.

In one embodiment, the detector grid has rectangular detector units. Accordingly, a commercially available detector can be used.

In another embodiment, a method for adapting a unit embodied as a detector grid and a unit embodied as a scattered radiation matrix of a radioscopy device to one another is provided.

In this embodiment, the moiré artifacts are suitably suppressed. In this embodiment, the two-dimensional Fourier transform of the two units is formed; the product of the Fourier transforms is formed; the integral across both location-frequency coordinates of the product is formed; and the units rotatable relative to one another are disposed relative to one another in such a way that the integral produces a minimum.

In one embodiment, a two-dimensional Fourier transform of the detector grid is formed. A circular ring, which defines the frequency of the scattered radiation matrix, is placed around the origin of the Fourier transform. A direction is selected in which the Fourier transform of the detector grid, evaluated on the circular ring, forms a minimum. The scattered radiation matrix is disposed relative to the detector grid perpendicular to that direction.

In one embodiment, the direction is selected for a predetermined frequency or number of lines of the scattered radiation matrix.

In one embodiment, a frequency at which the minimum is lowest is selected. The frequency may be selected as a further parameter, for example, as an addition to a choice of the direction. In this embodiment, the minimum is especially low, and the moiré artifacts are substantially eliminated.

In one embodiment, the geometry of the detector grid is variable. In this embodiment, a geometry of the detector grid with which the minimum is lowest may be selected, which allows elimination of the moiré artifacts.

DETAILED DESCRIPTION

Figure 1:
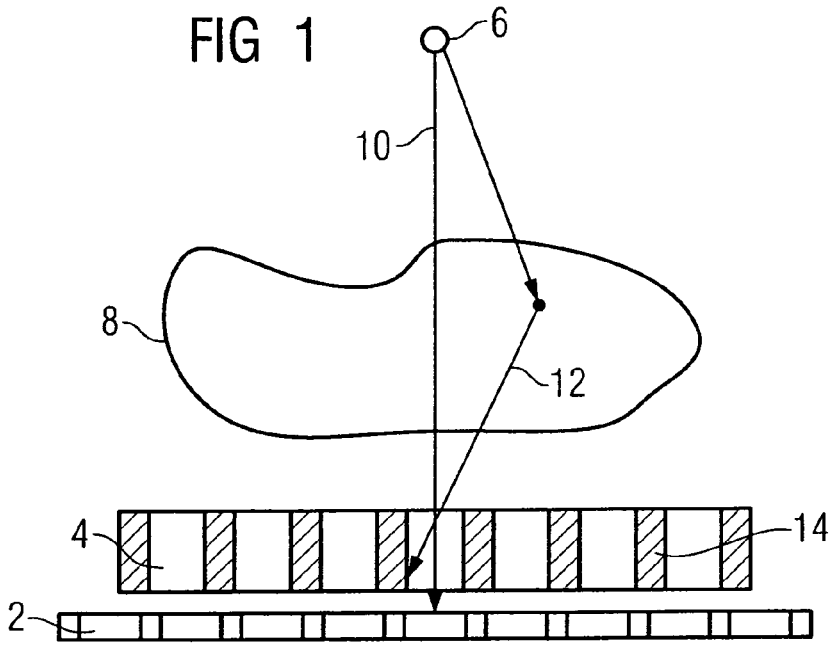
FIG. 1 shows one embodiment of a radioscopy device with a detector grid and a scattered radiation matrix.

In one embodiment, as shown in FIG. 1, a radioscopy device includes a detector grid 2 and a scattered radiation matrix 4 and a body 8 , which is disposed above the detector grid 2 and the scattered radiation matrix 4. Radiation 10 from a radiation source 6 passes through the body 8. Primary radiation 10 passing through the body 8 passes through the scattered radiation matrix 4 to strike the detector grid. Secondary radiation 12, which is deflected in the body 8, strikes members 14 of the scattered radiation matrix 4 and is absorbed there.

In one embodiment, the grid width of the scattered radiation matrix 4 is greater than the grid width of the detector grid 2. Moiré artifacts—except for an additive direct component—can be avoided if the detector grid 2 is precisely an integral multiple of the grid width of the scattered radiation matrix 4. One suitable adaptation of the grid widths to avoid moiré artifacts is when, for example, the scattered radiation matrix 4 is quite narrow. In the exemplary embodiment shown in FIG. 1, moiré artifacts can occur in the resultant image because of the interplay of the scattered radiation matrix 4 and the detector grid 2.

Figure 2:
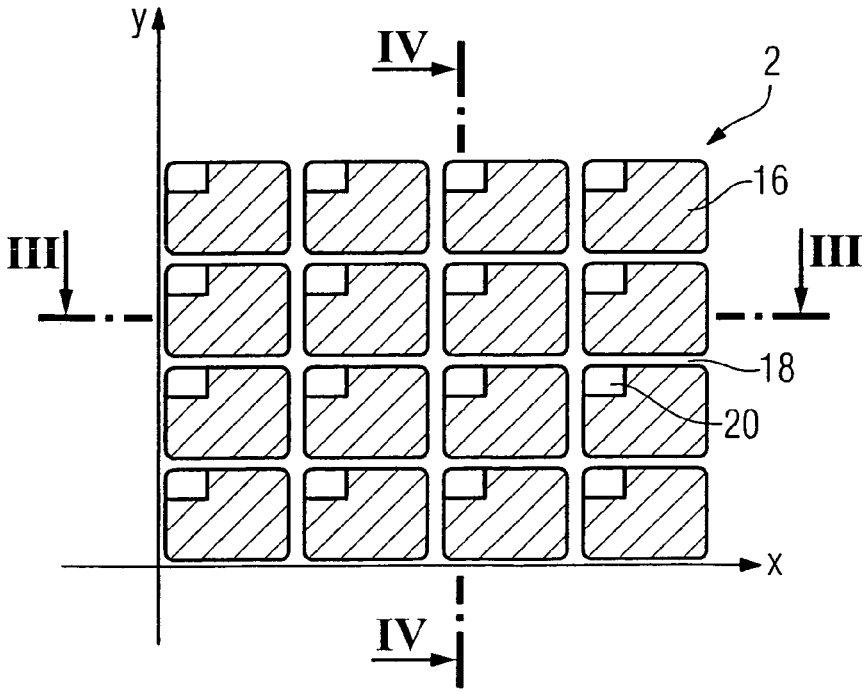
FIG. 2 is a top view of one embodiment of the detector grid.
Figure 3:
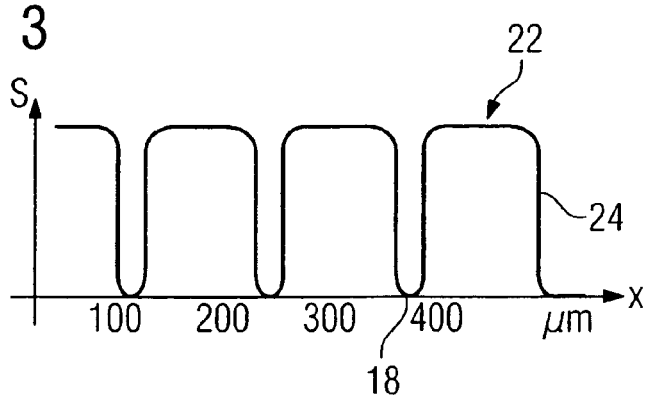
FIG. 3 is a location-signal graph along the X axis of the detector grid.
Figure 4:
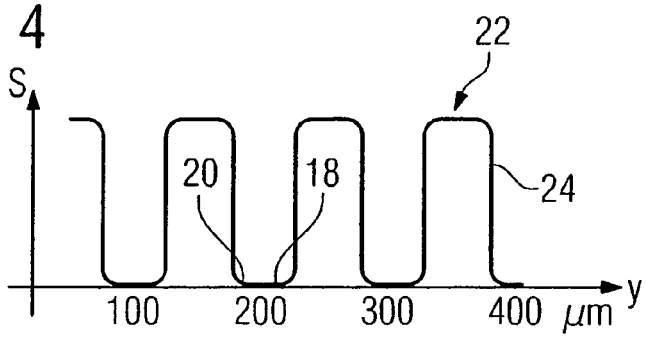
FIG. 4 is a location-signal graph along the Y axis of the detector grid.

FIG. 2 shows the detector grid 2 in a schematic top view in X-Y coordinate lines. The detector grid 2 includes a plurality of radiation-sensitive detector cells 16, between which radiation-insensitive members 18 extend. One switching element 20, which is radiation insensitive, is placed inside each of the detector cells 16. As shown in FIGS. 3 and 4, the arrangement of FIG. 2 creates a regular pattern 22 of radiation-sensitive and radiation-insensitive areas.

This pattern 22 is plotted in FIGS. 3 and 4 on the X axis and the Y axis in a section through the detector grid parallel to the X axis and the Y axis, respectively. As shown in FIGS. 3 and 4, a standardized signal 24 results from uniform irradiation of the detector grid 2. The standardized signal 24 occurs at radiation-sensitive points, while at radiation-insensitive points of the detector grid 2, for example, the members 18 and the switch elements 20, the standardized signal 24 disappears.

Figure 5:
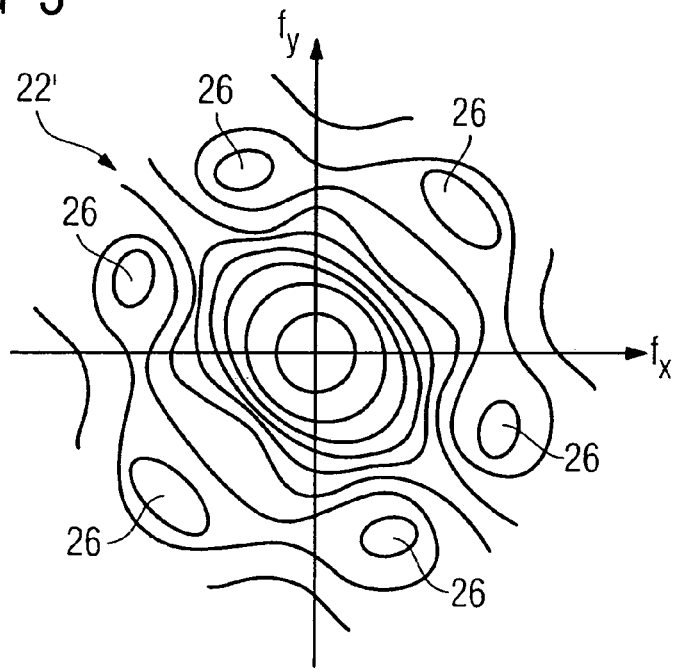
FIG. 5 shows one embodiment of the standardized two-dimensional Fourier transform of the signal of the detector grid in a contour line graph.

In FIG. 5, the two-dimensional Fourier transform 22' of the two-dimensional pattern 22 is plotted in a contour line diagram in the location-frequency coordinates $f_x$, $f_y$. Around the origin, the Fourier transform 22' is at an absolute maximum, which forms the flat tip of an approximately hexagonal Fourier signal crest. Disposed around the hexagonal Fourier signal crest are six minimum points 26, at which the Fourier transform 22' nearly disappears.

Figure 6:
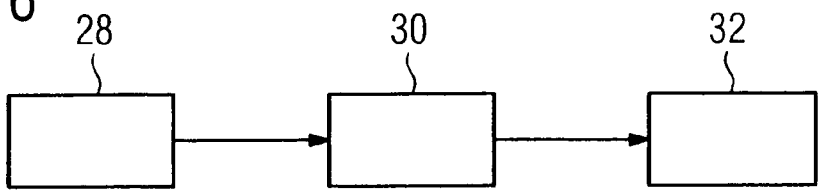
FIG. 6 shows a model of the creation of a detector image.

An occurrence of a copy of uniform radiation on the detector grid in the location-frequency space can be described using the periodic disposition of the detector cells 16 in the detector grid 2. As shown in FIG. 6, a simplified model of the copy may be illustrated as a series circuit of three blocks 28, 30, 32. The first block 28 is the standardized Fourier transform of the point response of the scintillator layer of the detector grid 2. The second block 30 is the standardized Fourier transform 22' of the detector grid 2, or of the sensitive regions of the periodically disposed detector cells 16, defined by the so-called aperture. The third block 32 is the subsequent scanning.

From the Fourier transform of the scattered radiation matrix 4 and the Fourier transform 22' of the detector grid 2, in an ensuing step, the product, and by way of the product, the integral across both location-frequency coordinates ($f_x$, $f_y$) can be formed, expediently over the entire location-frequency space. By rotation of the scattered radiation matrix 4 relative to the detector grid 2—and thus rotation of the Fourier transform of the scattered radiation matrix 4 relative to the Fourier transform 22' of the detector grid 2—the integral is now varied, until such time as the integral is at a minimum.

Figure 7:
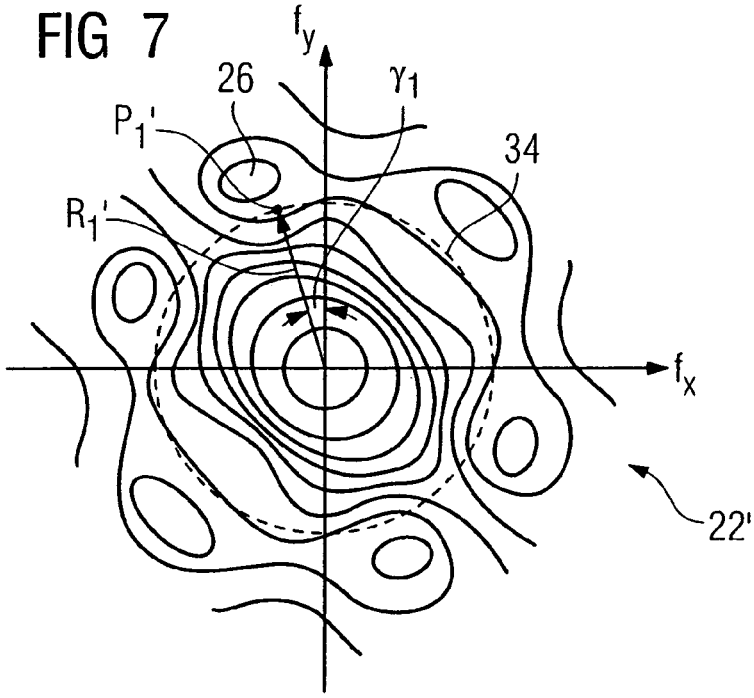
FIG. 7 shows the Fourier transform of FIG. 5, with a circular ring that defines the frequency of the scattered radiation matrix.
Figure 8:
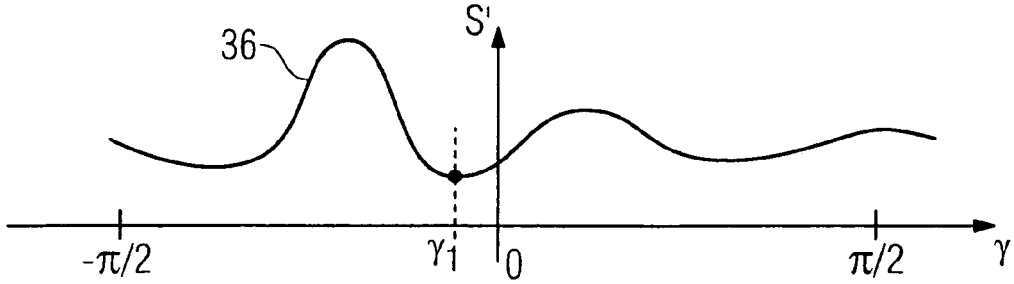
FIG. 8 shows the Fourier transform of FIG. 7, evaluated on the circular ring.
Figure 9:
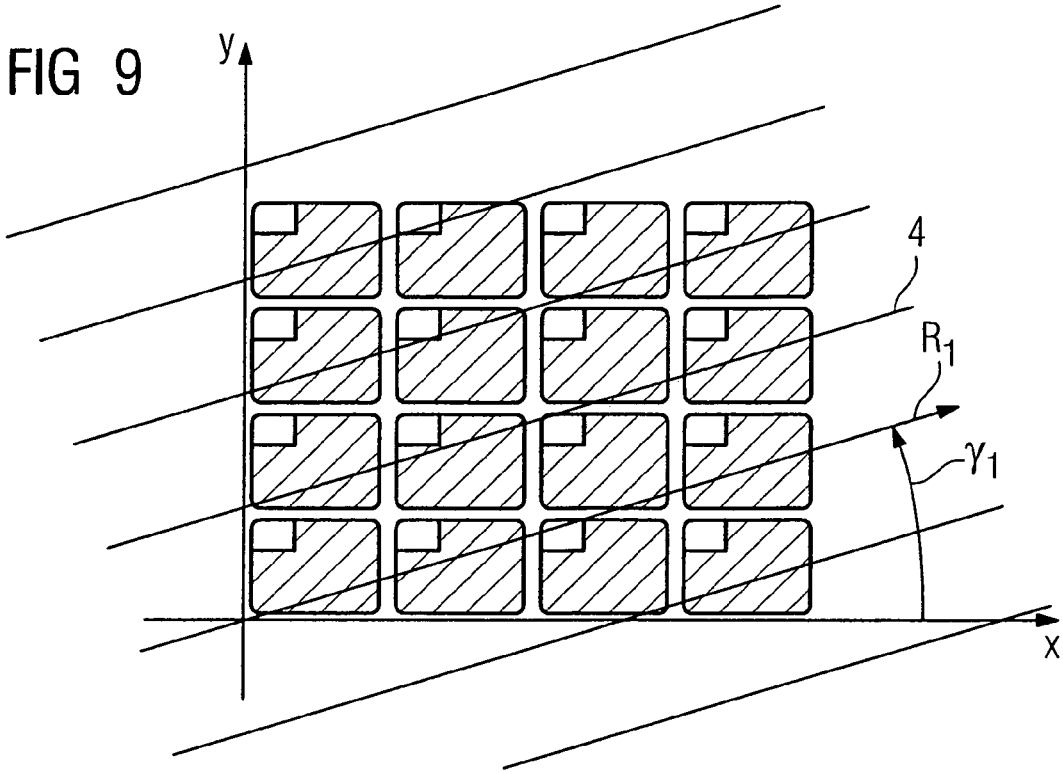
FIG. 9 shows a top view of one embodiment of the detector grid and the scattered radiation matrix.

In one embodiment, as shown in FIG. 9, the scattered radiation matrix 4 is a one-dimensional grid. In this embodiment, a course via the evaluation of a circle in the Fourier transform may be selected. The circle in the Fourier transform is shown in FIGS. 7 and 8. FIG. 7 shows the disposition of a predetermined scattered radiation matrix 4 on a predetermined detector grid 2 that leads to the most extensive possible suppression of the unwanted moiré artifacts.

FIG. 7 shows the Fourier transform 22' of FIG. 5 with an additional circular ring 34 around the origin. The radius of the circular ring 34 corresponds to the lay frequency (1/lay number) of the scattered radiation matrix 4. FIG. 8 illustrates a developed view 36 of the Fourier transform 22' along the upper half of the circular ring 34. The circular ring 34 intersects the Fourier transform 22' at different heights, as is shown in exaggerated form in FIG. 8. The developed view 36 represents the intersection line or the Fourier signal S' of the Fourier transform 22' on the circular ring 34 in a range of ±90° (i.e. $\pm\pi/2$) around the Y axis. As shown in FIG. 8, the developed view 36 has a number of minimum points. As illustrated in FIG. 7, the lowest minimum point is defined by a lay point $P_1'$ and is located at an angle $\gamma_1$ of approximately −17° to the Y axis. In one embodiment, the angle $\gamma_1$ may vary depending on the location of the switch elements 20 in the detector cells 16 and on their shape.

As shown in FIG. 7, an arrow is directed from the origin to the lay point $P_1'$ and is oriented in the direction $R_1'$, which corresponds to the angle $\gamma_1$. The direction $R_1'$ is perpendicular to the optimal lay direction $R_1$ that is shown in FIG. 9 and leads to extensive suppression of the moiré artifacts. The scattered radiation matrix 4 is rotated by the angle $\gamma_1$ of 17° relative to the X axis of the detector grid 2.

In one embodiment, the lay direction $R_1$ of the scattered radiation matrix 4 relative to the detector grid 2 is the lay direction $R_1$ that is associated with the lay point $P_1'$, which is located at the lowest possible minimum 26 of the Fourier transform 22'. In general, the lower the minimum 26, the better the suppression of the moiré artifacts in the X-ray image that can be produced.

Figure 10:
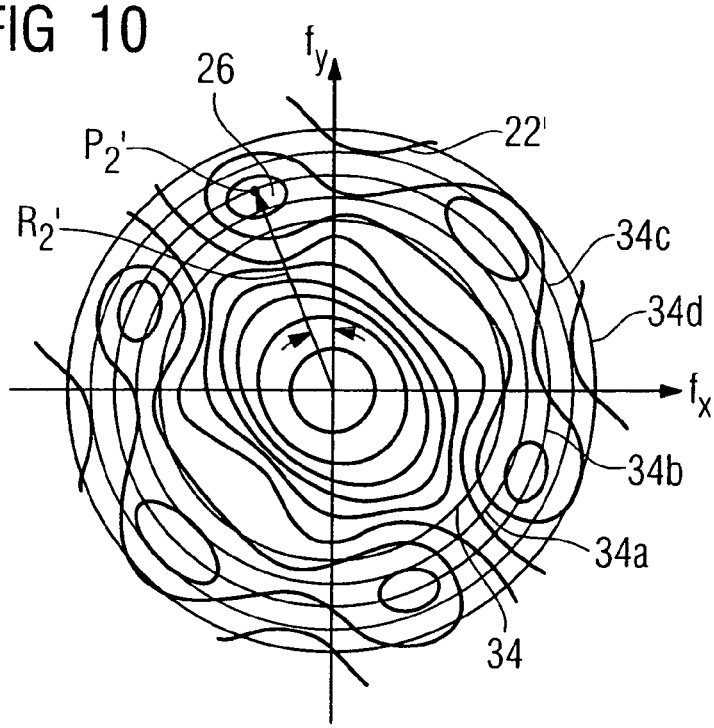
FIG. 10 shows the Fourier transform of FIG. 7 with a plurality of circular rings, each defining one frequency of a scattered radiation matrix.

A predetermined Fourier transform 22', which is based on a predetermined detector grid 2, is shown in FIG. 10. The radius of the circular ring 34 placed around the origin may be varied if the scattered radiation matrix is not predetermined and instead its lay frequency is freely selectable. In FIG. 10, four further circular rings 34*a-d* are shown. Each circular ring 34*a-d* represents higher lay frequencies than that of the circular ring 34 and are thus associated with narrower scattered radiation matrixes. Accordingly, a lay point $P_2'$ can be selected that is located at the lowest point of the lowest minimum 26 of the two-dimensional Fourier transform 22'. This lay point $P_2'$, using the radius of its circular ring 34*b*, defines both the lay frequency, for example, the grid width, and the optimal direction of the scattered radiation matrix, which is perpendicular to the direction $R_2'$. In FIG. 10, an arrow is placed from the origin in the direction $R_2'$ to the lowest lay point $P_2'$. For optimal suppression of the moiré artifacts, the lay direction of the scattered radiation matrix is selected to be perpendicular to the direction $R_2'$, which is analogous to the description of FIG. 9.

In one embodiment, instead of a defined detector grid 2, the scattered radiation matrix 4 may be defined. The dimensions, shape, and direction of a detector grid 2 or of the individual detector elements relative to the predetermined scattered radiation matrix 4 may be varied such that the lowest possible lay point and optimal suppression of the moiré artifacts are achieved.

In one embodiment, both the detector grid 2 and the scattered radiation matrix 4 are freely selected. In this embodiment, even greater freedom and capability of obtaining an even lower lay point may be achieved. The detector grid 2, for example, can first be designed so that its two-dimensional Fourier transform is at the lowest possible point. The lay point may then be determined and the grid width and the lay direction of the scattered radiation matrix 4 may be defined.

Figure 11:
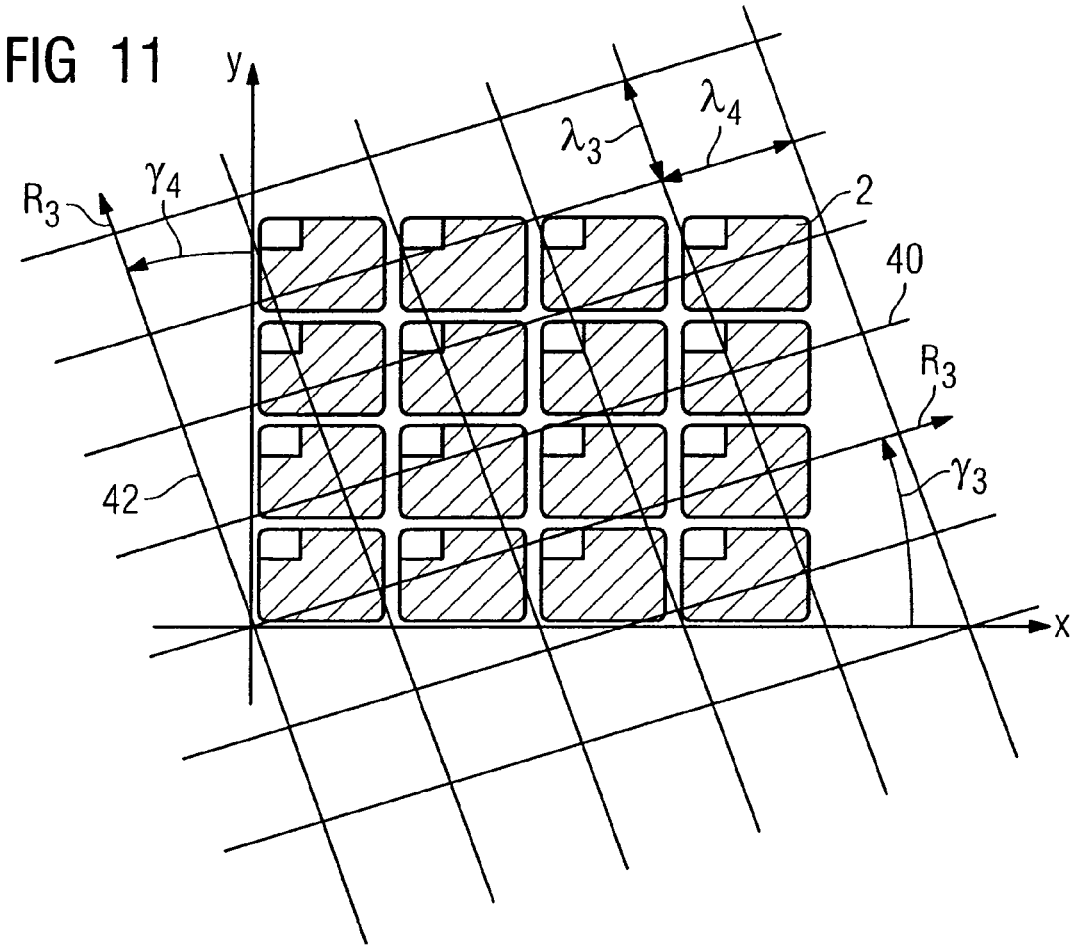
FIG. 11 shows the detector grid and a two-dimensional scattered radiation matrix.
Figure 12:
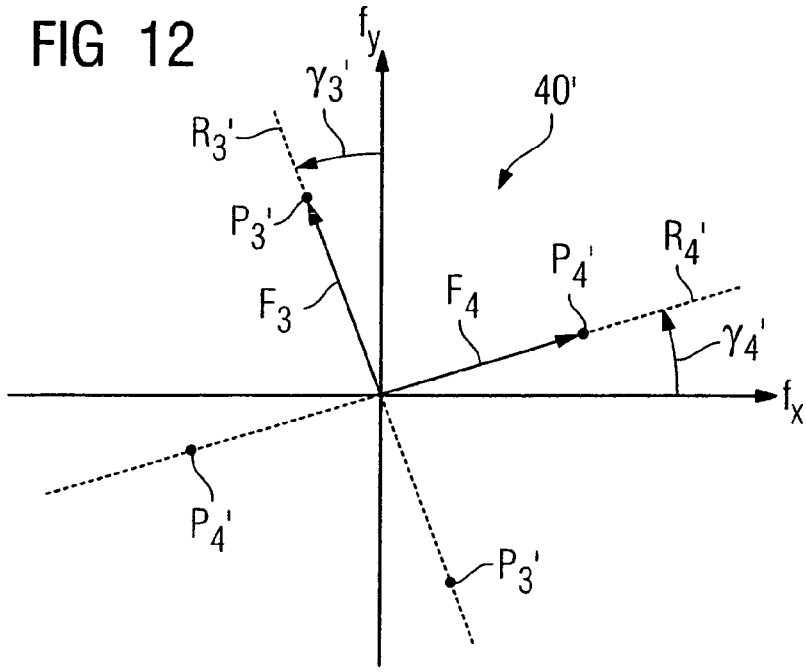
FIG. 12 shows Dirac pulses of one embodiment of the two-dimensional scattered radiation matrix in the Fourier transform.

In one embodiment, as shown in FIG. 11, a two-dimensional scattered radiation matrix 40 has rectangular radiation-permeable cells with grid widths $\lambda_3$ and $\lambda_4$ between radiation-absorbing members 42. FIG. 11 shows the detector grid 2 with the two-dimensional scattered radiation matrix 40. If, on the basis of the radiation pattern of this scattered radiation matrix 40, the two-dimensional Fourier transform 40' is plotted in location-frequency coordinates $f_x$, $f_y$, then a pattern is obtained with essentially four Dirac pulses $P_3'$, $P_4'$, which are shown in FIG. 12.

In one embodiment, the Dirac pulses $P_3'$, $P_4'$ are disposed in the form of the grid corners of the scattered radiation matrix 40, but rotated 90° away from them. Identically numbered Dirac pulses $P_3'$, $P_4'$ are equivalent to one another. The distances $F_3$, $F_4$ of the Dirac pulses $P_3'$, $P_4'$ from the origin are reciprocally proportional to the grid widths $\lambda_3$ and $\lambda_4$; that is:

$$F_3=1/\lambda_3, \text{ and } F_4=1/\lambda_4.$$

The directions $R_3'$, $R_4'$ of the Dirac pulses $P_3'$, $P_4'$ are rectangular to the directions r3, r4 of the members 42 of the scattered radiation matrix 40, and the angles $\gamma_3$ and $\gamma_4$ of the members 42, because of the rectangular nature of the scattered radiation matrix 40, are the same and are the same as the angles $\gamma_3'$ and $\gamma_4'$ of the Dirac pulses $P_3'$, $P_4'$.

Figure 13:
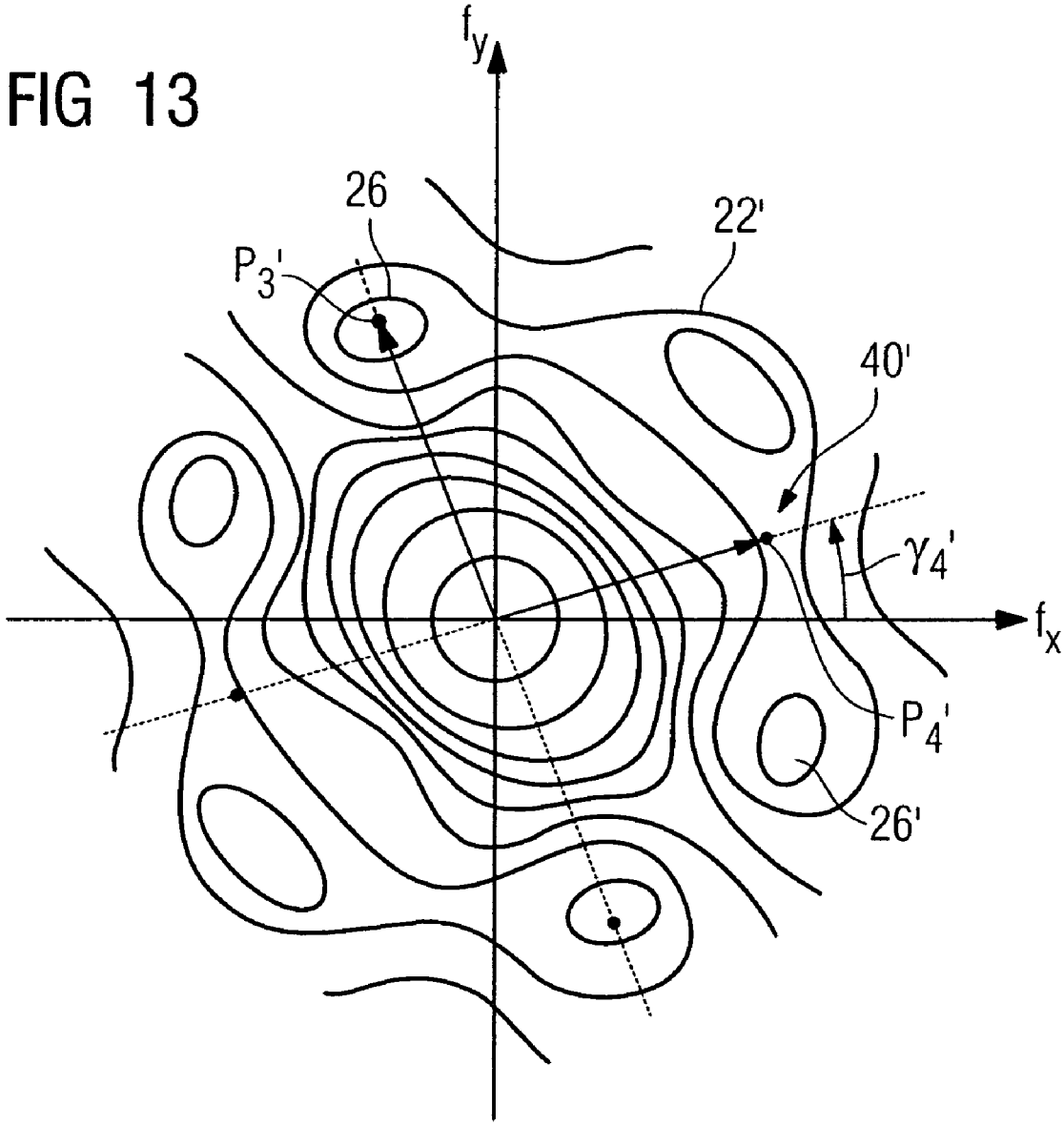
FIG. 13 shows the Fourier transform of FIG. 7 with the Dirac pulses of FIG. 12.

The integration of the product across both Fourier transforms 22', 40' will be described now taking as an example the illustration in FIG. 13. The integral C can be represented as the following:

$$\int_{-\infty}^{+\infty} C = |F(\text{scattered radiation matrix}) \cdot F(\text{detector grid}) d f_x, d f_y,$$

in which F stands for the Fourier transforms 22', 40', and the integration is performed via both coordinates $f_x$ and $f_y$, in each case for $-\infty$ to $+\infty$. Because of the fading property of the Dirac pulses, the Fourier transform 40' can be reduced to the four Dirac pulses $P_3'$, $P_4'$, so that for standardized Fourier transforms 22', 40', the result is:

$$C=2\ (F(\text{detector grid})|_{P3}+F(\text{detector grid})|_{P4})$$

and the integral C results from the sum of the values of the Fourier transform 22' of the detector grid 4 to the four points of the Dirac pulses $P_3'$, $P_4'$.

In order to optimally counteract unwanted moiré artifacts, the integral C —taking the existing given conditions into account—should be minimized. For example, as is shown in FIG. 13, the predetermined scattered radiation matrix 40 can be rotated such that the Dirac pulses $P_3'$, $P_4'$ are located as much as possible at minimum points 26 of the Fourier transform 22' of the detector grid 4. The Dirac pulse $P_3'$ is located at a minimum 26, and the Dirac pulse $P_4'$ is located in a trough of the Fourier transform 22'.

In one embodiment, optimal suppression of the moiré artifacts may be attained if the scattered radiation matrix 40 and the location of the Dirac pulses $P_3'$, $P_4'$ are selectable. In this embodiment, both Dirac pulses $P_3'$, $P_4'$ are located at minimum points 26, and thus the integral C can be minimized. In this embodiment, the grid widths $\lambda_3$ and $\lambda_4$ and the angles $\gamma_3$ and $\gamma_4$ of the grid members to one another are variable.

In one embodiment, a numerical integration may be done via the product of the Fourier transforms. For example, when complicated scattered radiation matrixes or wide grid members are provided, and the approximation via the Dirac pulses $P_3'$, $P_4'$, is unsatisfactory, a numerical integration can be done via the product of the Fourier transforms. In this embodiment, to keep the integration simple, an initial integration may be done only in the region of the strongest oscillations of the scattered radiation matrix 40, for example, by integrating or totaling not only at the locations of the four Dirac pulses $P_3'$, $P_4'$, but also at a plurality of points of the greatest oscillations. The value there of the Fourier transform 22' is then be multiplied by the intensity of the oscillation. If even this more-extensive approximation is unsatisfactory, then integration can be done over wider ranges. In an extreme case, integration can be done over the entire location-frequency space.

Various embodiments described herein can be used alone or in combination with one another. The forgoing detailed description has described only a few of the many possible implementations of the present invention. For this reason, this detailed description is intended by way of illustration, and not by way of limitation. It is only the following claims, including all equivalents that are intended to define the scope of this invention.

The invention claimed is:

1. A radioscopy device, comprising:

a detector grid; and a scattered radiation matrix, wherein the detector grid is disposed relative to the scattered radiation matrix substantially perpendicular to a direction in which an integral across both location-frequency coordinates of Fourier transforms of the detector grid and the scattered radiation matrix is substantially at a minimum.

2. The radioscopy device as defined by claim 1, wherein the Fourier transform of the scattered radiation matrix is simplified to Dirac pulses, and the integration is approximated to the points of the Dirac pulses by the sum of the values of the Fourier transform of the detector grid.

3. The radioscopy device as defined by claim 1, wherein the detector grid is disposed relative to the scattered radiation matrix, which is substantially perpendicular to a direction in which the two-dimensional Fourier transform of the detector grid, evaluated on a circular ring placed around an origin of the Fourier transform is at a minimum, wherein the ring characterizes a frequency of the scattered radiation matrix.

4. The radioscopy device as defined by claim 1, wherein the detector grid and the scattered radiation matrix have a regular structure.

5. The radioscopy device as defined by claim 1, wherein the scattered radiation matrix includes a one-dimensional grid.

6. The radioscopy device as defined by claim 1, wherein frequencies of the detector grid and the scattered radiation matrix differ from one another by a factor of 2.

7. The radioscopy device as defined by claim 6, wherein the frequencies of the detector grid and the scattered radiation matrix differ from one another by a factor of 2 or less.

8. The radioscopy device as defined claim 1, wherein the grid width of the scattered radiation matrix is wider than the grid width of the detector grid.

9. The radioscopy device as defined claim 8, wherein the grid width of the scattered radiation matrix is only slightly wider than the grid width of the detector grid.

10. The radioscopy device as defined by claim 1, wherein the detector grid has rectangular detector cells.

11. A method for adapting a detector grid and a scattered radiation matrix of a radioscopy device to one another, the method comprising:

forming a two-dimensional Fourier transform for the detector grid;

forming a two-dimensional Fourier transform for the scattered radiation matrix;

forming a product of the Fourier transforms;

forming an integral across both location-frequency coordinates of the product; and rotating the detector grid and the scattered radiation matrix relative to one another, so that the detector grid and the scattered radiation matrix are disposed relative to one another in such a way that the integral substantially produces a minimum.

12. The method as defined by claim 11, comprising: selecting a frequency at which the minimum is lowest.

13. The method as defined by claim 10, comprising: selecting a geometry of the detector grid with which the minimum is lowest.

14. The method as defined by claim 11, comprising: selecting a geometry of the detector grid with which the minimum is lowest.

15. A medical examination device for examining an object, comprising:

an X-ray source;

a detector grid; and a scattered radiation matrix, wherein the detector grid is disposed relative to the scattered radiation matrix substantially perpendicular to a direction in which an integral across both location-frequency coordinates of Fourier transforms of the detector grid and the scattered radiation matrix is at a minimum, and wherein the object is disposed between the X-ray source and the scattered radiation matrix.

16. The radioscopy device as defined by claim 15, wherein the Fourier transform of the scattered radiation matrix is simplified to Dirac pulses, and the integration is approximated to the points of the Dirac pulses by the sum of the values of the Fourier transform of the detector grid.

17. The radioscopy device as defined by claim 15, wherein the detector grid is disposed relative to the scattered radiation matrix, which is substantially perpendicular to a direction in which the two-dimensional Fourier transform of the detector grid, evaluated on a circular ring placed around a origin of the Fourier transform is at a minimum, wherein the ring characterizes a frequency of the scattered radiation matrix.

* * * * *